United States Patent [19]

Swann

[11] 4,147,908

[45] Apr. 3, 1979

[54] ELECTRIC SWITCHES

[76] Inventor: David A. Swann, 17-21 Carinish Rd., Clayton, Victoria, Australia, 3168

[21] Appl. No.: 755,584

[22] Filed: Dec. 30, 1976

Related U.S. Application Data

[63] Continuation of Ser. No. 634,174, Nov. 21, 1975, abandoned.

[30] Foreign Application Priority Data

Nov. 25, 1974 [AU] Australia ..... 9740
Dec. 3, 1974 [AU] Australia ..... 9857

[51] Int. Cl.[2] ..... H01H 13/28

[52] U.S. Cl. ..... 200/67 G; 200/241; 200/153 N

[58] Field of Search ..... 200/67 G, 68, 241, 243, 200/255, 153 N, 16 C

[56] References Cited

U.S. PATENT DOCUMENTS

| | | | |
|---|---|---|---|
| 2,400,849 | 5/1946 | Stearns | 200/67 B |
| 2,966,560 | 12/1960 | Gluck | 200/67 G X |
| 3,548,131 | 12/1970 | Piber | 200/241 |
| 3,598,943 | 8/1971 | Barrett | 200/67 B |
| 3,604,868 | 9/1971 | Batcheller | 200/67 G |
| 3,711,699 | 1/1973 | Bacevius | 200/67 G X |

FOREIGN PATENT DOCUMENTS

| | | | |
|---|---|---|---|
| 487261 | 1953 | Italy | 200/67 G |

*Primary Examiner*—J. V. Truhe
*Assistant Examiner*—M. H. Paschall
*Attorney, Agent, or Firm*—Cushman, Darby & Cushman

[57] ABSTRACT

The invention provides a contact bridging member for an electric switch wherein, in use, a contact bridging member is slid by an actuator over a fulcrum and in so doing pivots thereabout to bring the leading end of the member into or out of contact with, or the trailing end out of or into contact with, an electrical contact; the contact bridging member having an abutment member adapted to be acted upon by the actuator in the aforesaid manner and wherein the abutment member projects from one side of the contact bridging member and is an outwardly struck portion thereof.

The invention also provides switches incorporating that contact bridging member.

The contact bridging member may be curved suitably for use in linearly, arcuately or rotary acting switches.

10 Claims, 11 Drawing Figures

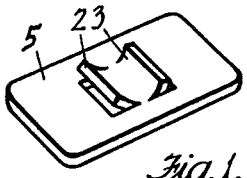
Fig. 1.
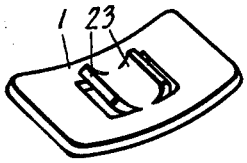
Fig. 4.
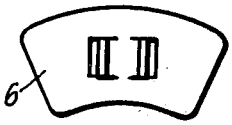
Fig. 5.
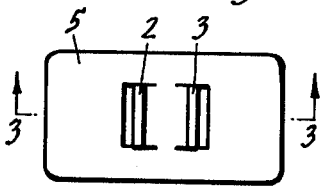
Fig. 2.
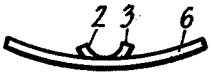
Fig. 6.
Fig. 3.
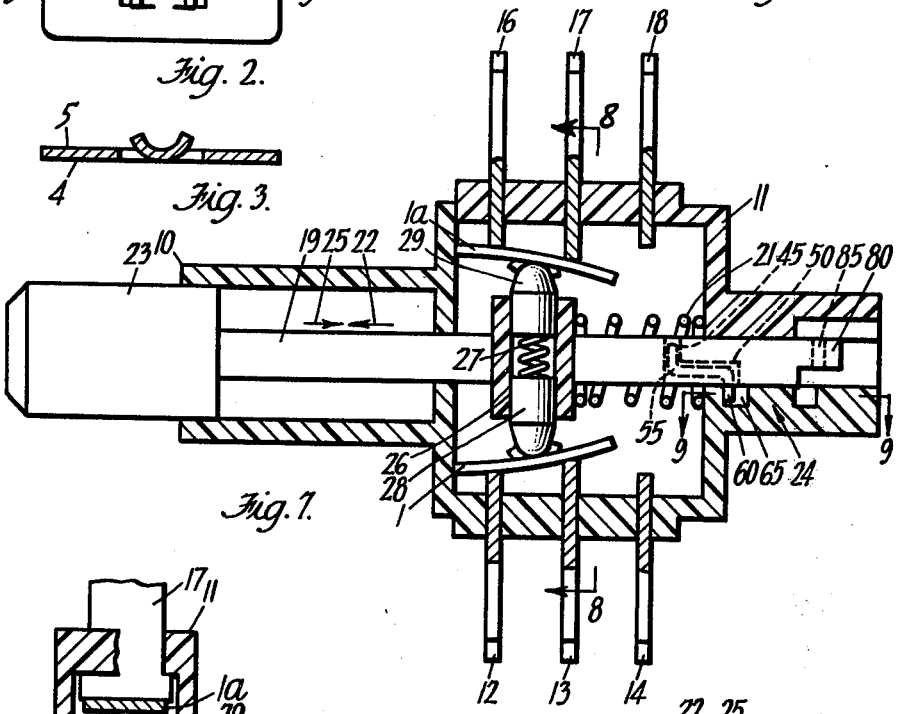
Fig. 7.
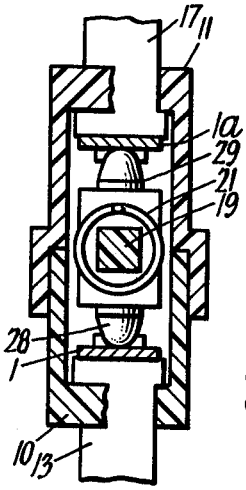
Fig. 8.
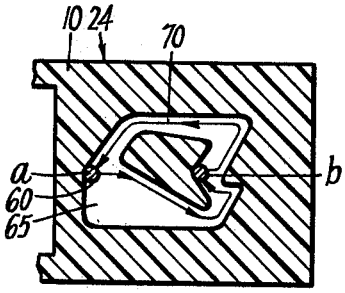
Fig. 9.
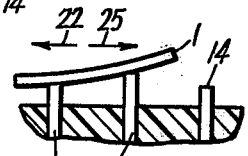
Fig. 10.
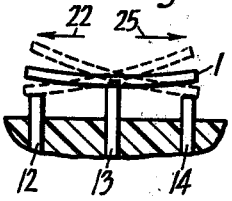
Fig. 11.

ELECTRIC SWITCHES

This is a continuation, of application Ser. No. 634,175 filed Nov. 21, 1975, now abandoned.

BACKGROUND OF THE INVENTION

FIELD OF THE INVENTION

This invention relates in one aspect to a contact bridging member and also to switches incorporating same.

Reference is made of our co-pending Australian Patent Application No. PB 9740, filed Nov. 25, 1974, and the whole of the subject matter of the Specification thereof is to be considered as being imported hereinto and it is to be noted that the present invention will find application therein. Reference is also made to an application (hereinafter called "said application") filed in the same country as this application, based on Australian Patent Application No. PB 9740 and relating to electric switches having a particular form of contact bridging member. Reference is also made to an application filed in the same country and numbered No. PB 9857. The last mentioned can use the member of this invention.

SUMMARY OF THE INVENTION

The present invention provides a contact bridging member for an electric switch wherein, in use, a contact bridging member is slid by an actuator over a fulcrum and in so doing pivots thereabout to bring the leading end of the member into and out of contact with, or the trailing end into or out of contact with, an electrical contact; the contact bridging member having an abutment member adapted to be acted upon by the actuator in the aforesaid manner and wherein the abutment member projects from one side of the contact bridging member and is an outwardly struck portion thereof.

PREFERRED FEATURES OF THE INVENTION

As it will be usual for the contact bridging member to be movable in two mutually opposite directions it is preferred that there are two such abutment members and that each projects from one and the same side of the contact bridging member and each is an outwardly struck portion of the contact bridging member.

By the abutment members being outwardly struck portions the opposite side of the contact member will not need to have any projections therefrom and thus the fulcrum will not need to accommodate the passing of any projection as do the contacts in, say, FIGS. 11–14 of said application which are provided with slots 106. Thus the full width of the fulcrum, a continuous surface as presented to the contact bridging member, is available to contact the contact bridging member and this enables heavier current carrying then otherwise and, we believe, less difficulty with arcing. Further, slotted contacts add to cost and in this invention only one form of contact needs to be used in many switches. Further, it is believed that the consequent ability to have the operator at all times to one side of the fulcrum a better action is obtained particularly where the contact bridging member is arcuate as in certain aspects of said application.

The contact bridging member, with the exception of the abutment members, may be flat, it may have upturned ends, it may be arcuate and it may also be curved to suit a rotary switch and in these instances it will find application in the switches shown in said application. Indeed, what is disclosed therein relating to the form of the contact bridging member thereof is applicable to the contact member of the present invention.

The contact bridging member most preferably has a length at least twice the spacing of adjacent contacts.

The abutment members may be so shaped as to provide a nest for the actuator but it is usually sufficient if the abutment members merely extend transverse to the directions of motion of the contact bridging member.

The outwardly struck portions can conveniently be formed in a stamping operation.

The present invention also provides a switch having such a contact bridging member.

The present invention also provides an electric switch comprising a contact bridging member, a fulcrum and an actuator adapted to slide the contact bridging member over the fulcrum and constructed and arranged so that in so doing the contact bridging member pivots thereabouts to bring the leading end of the contact bridging member into or out of contact with, or the trailing end into or out of contact with an electrical contact and characterized in that the contact bridging member has an abutment member adapted to be acted upon by the actuator in the aforesaid manner and wherein the abutment member projects from one side of the contact bridging member and is an outwardly struck portion thereof.

It is particularly preferred that the surface of the fulcrum which contacts the contact bridging member is a continuous surface.

The present invention also provides an electric switch having a mechanism comprising an actuator, a contact bridging member capable of being moved along a path by the actuator and two spaced apart electric contacts arranged along said path; wherein one of said contacts functions, in use, as a fulcrum and wherein said member is so shaped and the switch is constructed and arranged that said member is movable from a first position in which it is in contact with said contacts, slideably with respect to said contacts and in so doing initially rotates in one direction and thereafter pivots about the fulcrum in a rotation of opposite direction whereby to come out of contact with the other of said contacts and further characterized in that the contact bridging member has an abutment member adapted to be acted upon by the actuator in the aforesaid manner and wherein the abutment member projects from one side of the contact bridging member and is an outwardly struck portion thereof.

This invention will be illustrated by way of nonlimiting examples with the aid of the accompanying drawings.

BRIEF DESCRIPTION OF THE VIEWS OF THE DRAWINGS

FIG. 1 is a perspective view of a first contact bridging member in accordance with this invention, FIG. 2 is a plan view of the member shown in FIG. 1, FIG. 3 is a cross-section on line 3—3 in FIG. 2, FIG. 4 is a perspective view of a second contact bridging member in accordance with this invention, FIG. 5 is a plan view of a third contact bridging member in accordance with this invention, FIG. 6 is an elevation of the member shown in FIG. 5 (however, it should be noted that the member shown in FIG. 4 would have an electrical appearance identical to FIG. 6), FIG. 7 is a cross-section of a switch which uses the contact bridging member of FIG. 4, FIG. 8 is a cross-section on line 8—8 in FIG. 7, FIG. 9 is a cross-section on line 9—9 in FIG. 7

FIG. 10 is a schematic representation of the operation of the switch of FIG. 7, and FIG. 11 is another schematic representation of the operation of the switch of FIG. 7.

DETAILED DESCRIPTION

The contact bridging member 5 shown in FIGS. 1–3 is formed from metal strip in a single stamping operation which defines its perimeters and forms the outwardly struck portions 2 and 3 which serve as abutment members to be operated on by an actuator in an electric switch.

It will be noted particularly from FIG. 3 that the underside 4 of the member has no projections.

The contact bridging member 6 shown in FIGS. 5 and 6 is similar to that shown in FIGS. 1–3 excepting that it is arcuate both in plan and elevation so as to enable it to be used in a rotary switch as disclosed in said application; for instance, the rotary switch of FIGS. 16–21 of said application.

The contact bridging member 1 shown in FIG. 4 is similar to that shown in FIGS. 1–3 excepting that it is arcuate when seen in elevation (i.e., it would appear as does the member 6 as shown in FIG. 6) so that it may be used in the switch shown in FIG. 11–14 of said application.

The switch shown in FIGS. 7–9 exemplifies the use of contact bridging members in accordance with this invention.

The switch shown in FIGS. 7–9 comprises a body, comprised of a part 10 and a part 11 which snap-fittingly engage with one another, which mounts a first set of contacts 12, 13 and 14 and a second set of contacts 16, 17 and 18.

Within the body is an actuator 19 which is biased by a spring 21 in the direction of arrow 22. The actuator is reciprocably moveable in the direction of arrow 22 and the opposite direction 25.

At one end of the actuator is mounted a press-button 23 and the other end of the actuator there is catch means indicated generally by 24 to be described in more detail later in this specification.

Intermediate the ends of the actuator there is a through bore 26 in which is located a coil spring 27 which bears on pins 28 and 29.

A contact bridging member is provided for each of the sets of contacts and is located by a respective one of pins 28 and 29.

The contact bridging member for contacts 12, 13 and 14 is numbered 1 and is identical in all respects to the contact bridging member 1 of FIG. 4.

The contact bridging member for contacts 16, 17 and 18 is numbered 1*a* and is identical in all respects to member 1.

The manner of operation of the above described switch is similar in many respects to the switches shown in said application and reference is directed thereto. However, the manner of operation is illustrated in FIGS. 10 and 11 hereof. In brief, in FIG. 10 the member 1 is shown in relation to the contacts 12, 13 and 14. By moving member 1 in the direction of arrow 22 it slides with respect to contacts 12 and 13 and because of its arcuate shape its leading and trailing ends respectively rotate anti-clockwise and clockwise. Thus the leading end also has a component of motion away from contact 14. The member 1 then comes to the position shown in the solid line in FIG. 11.

However, it is to be noted that the position shown in the solid line in FIG. 11 is an unstable position. From there is may pivot to contact 14 or return to contact 12 dependant on whether the actuator is moved in the direction of arrow 22 or 24.

Member 1*a* moves similarly.

The catch mechanism, which can serve to hold the actuator in such a position that contacts 13 and 14, 17 and 18 are bridged by members 1 and 1*a* is shown particularly in FIGS. 7 and 9.

In this respect, the actuator has a hole 45 and a relieved portion 50 both of which are shown by dash lines. A generally Z-shaped member 55 (shown in dotted line in FIG. 8) is received at one end in hole 45 and the other end, 60, is located in a channel 65 of particular form in body part 10 (see, particularly, FIG. 9).

Operation of the actuator causes the end 60 to move in the channel as shown by the line 70 and in the directions indicated by arrow heads. The end 60 is stable only when in the positions denoted a and b which correspond, respectively, to the position of the actuator shown in FIG. 7 and a position in which contacts 13 and 14, and contacts 17 and 18 are bridged by members 1 and 1*a*; all other positions are unstable and tend to revert to one or other of the stable positions.

The switch shown in FIGS. 7–9 is a double pole, double throw switch and may be modified by omitting contacts, 16, 17 and 18 to make it single pole, double throw or contacts 14, 16, 17 and 18 to make it single pole, single throw. Other modifications will be apparent.

The switch shown in the drawings can be used as a pull-switch by pulling on end 80 and a hole 85 is provided in that end which can engage a pullable member.

It is to be noted that member 5 may be used in lieu of member 1 but contacts 13 and 17 will probably need relocation and in any case a flat contact bridging member is not preferred.

In the switch described above with respect to FIGS. 7–9, advantages accrue from the use of the contact bridging member.

Among those advantages are those consequent on its arcuate shape and reference is made to said application for a description of these.

Other advantages are consequent on the contact bridging member having outwardly struck abutments and the co-operation of the contact bridging member with the contacts 13 and 17 which, it is to be noted, do not have the slot 106 of the contact shown in FIG. 7 of said application but which are instead generally planar on their ends and thus the whole of the ends can carry current. This additional current carrying area seems to result in less arc, longer switch life and higher current ratings than occurs with the contacts shown in FIG. 7 of application.

In this respect it is conceded that the holes in the contact bridging member formed in consequence of the striking out of abutments 2 and 3 do reduce the current carrying capacity of the contact bridging members but it is pointed out that this reduction is not at a region of sliding contact during actual switching and is thus of little consequence.

Further, the fact that contacts 13 and 17 can be identical to contacts 12, 14, 16 and 18 means only one type of contact needs to be stocked and assembled. Thus certain assembly errors are eliminated and stock holding costings are reduced. Further, the need to make or buy only one terminal, although perhaps small for small quantities of switches is of material importance to any large scale production that small savings can make major differences to sales.

Further, having pins 28 and 29 at all times more adjacent the actuator than a surface including contacts 12 and 13 or 16 and 17 produces, it is believed, a superior action.

Many modifications and adaptations may be made to the inventions described above without departing from the spirit and scope of this invention which includes every novel feature and combination of features disclosed herein.

A typical switch in accordance with FIGS. 7–9 of the drawings has contacts which are all the same and the contacts are mounted at slightly different levels in consequence of casing formations. The contacts are about 0.05mm thick about 18mm long and are contacted over a width of about 6mm by the contact bridging member and have a maximum width of about 7mm. The contacts are located in the casing so that the casing interior ends of contacts 13 and 17 lie in planes spaced about 0.5mm or less from planes including the casing interior ends of contacts 12 and 14 and 16 and 18 and the contacts are spaced from adjacent contacts at centres spacings of about 6.5mm and adjacent surface spacings of about 5.5mm.

The contact bridging member of that typical switch is arcuate, has a developed length of about 13.5mm, has a radius of arcuate curvature of about 44.5mm, is about 0.7mm wide, has the abutment members struck out from a portion about 3.6mm wide and about 4.7mm long and wherein the abutment members and the portion of the contact bridging member between them define a curved surface for receiving pins 28 and 29 of a radius of about 1.2mm.

Further, the corners of the contact bridging member are rounded at a radius of about 0.8mm. This slight rounding is of some significance in that in early experiments applicant merely trimmed right angled corners at 45° (trimming off a portion with sides adjacent the right angle of about 2mm in length) and found that the contact bridging member, by being comparatively pointed had a tendency to arc. Leaving the corners square was not considered practical as such corners can often be sharp and thus a small rounding was chosen. Still further, this trimming of the surface at 45° reduced the wiping surface thus reducing self cleaning.

The claims form part of the disclosure of this specification.

I claim:

1. A contact bridging member for an electric switch of the type wherein a contact bridging member is slid by an actuator over a fulcrum and in so doing pivots thereabout to bring the leading end of the member into contact with, or the trailing end out of contact with, an electrical contact; said contact bridging member comprising a unitary conductive piece having an integral abutment member adapted to be acted upon by the actuator in the aforesaid manner to effect said sliding; said abutment member comprising at least two tabs formed by partially severing the contact bridging member and bending resultant tabs outward from the contact bridging member to project from that side of the contact bridging member which, in use, is remote from said contact and fulcrum.

2. A contact bridging member as claimed in claim 1, and having two such abutment members each projecting from said same side of the contact bridging member and wherein each is an outwardly struck portion of the contact bridging member.

3. A contact bridging member as claimed in claim 1, wherein that side of the contact bridging member which in use contacts the fulcrum is flat.

4. A contact bridging member as claimed in claim 1, wherein that side of the contact bridging member which in use contacts the fulcrum has upturned ends or is arcuate.

5. A contact bridging member as claimed in claim 4, wherein the contact bridging member is a sector of an annulus.

6. In an electric switch comprising a contact bridging member, a fulcrum and an actuator adapted to slide the contact bridging member over the fulcrum such that the contact bridging member pivots about said fulcrum to bring the leading end of the contact bridging member in contact with, or the trailing end out of contact with an electrical contact; the improvement wherein said contact bridging member comprises a singular conductive piece having an integral abutment member adapted to be acted upon by the actuator to effect said sliding and wherein the abutment member comprises at least two tabs formed by partially severing the contact bridging member and bending the resultant tabs outward from the contact bridging member to project from that side of the contact bridging member remote from said contact and fulcrum.

7. An electric switch as claimed in claim 6 and further characterized in that the surface or edge of the fulcrum which contacts the contact bridging member extends at least substantially the full width of the contact bridging member measured transversely to the direction of sliding over the fulcrum and provides a continuous contacting surface to said bridging member.

8. A contact bridging member as claimed in claim 2, wherein the abutment members are so shaped as to form a nest adapted to receive part of the actuator.

9. An electric switch comprising an actuator, a contact bridging member adapted for sliding movement along a path responsive to an external force on said actuator, and two spaced apart electric contacts disposed along said path, one of said contacts being elevated with respect to the other, whereby said contact functions as a fulcrum;

said bridging member having a first side for contacting said electric contacts, and including an area intermediate its ends on the side opposite said contacting side, including first and second tabs formed by partially severing the bridging member and bending the resultant tabs outward from said bridging member to project from said opposite side;

said actuator including means cooperating with said first and second surface portions, for applying a continuous force to said bridging member in a direction towards said contacts, divergant from the direction of said sliding movement, whereby said continuous force causes rotational movement of said bridging member about said fulcrum in a first or second rotational direction in accordance with the relative position of said area with respect to said fulcrum to nest said bridging member in a first inclined position whereby a portion thereof lies along a line joining surfaces of contacts, or a second inclined position whereby said bridging member portion is removed from said other contact;

said actuator cooperating with said area protruding inclined surfaces, responsive to said external force, to apply a further force to said bridging member to effect said sliding movement, said further force including a component to counteract said continuous force such that said bridging member becomes unnested from its original inclined position, and ultimately pivots about the fulcrum into the other inclined position, said continuous force thereafter nesting said bridging member in said second inclined position until application of further external force to said actuator.

10. An electric switch as claimed in claim 9 and further characterized in that the surface or edge of the fulcrum which contacts the contact bridging member extends at least substantially the full width of the contact bridging member measured transversely to the direction of sliding over the fulcrum and is a continuous surface or edge.

* * * * *